US011364522B2

(12) United States Patent
Eastwood et al.

(10) Patent No.: US 11,364,522 B2
(45) Date of Patent: Jun. 21, 2022

(54) METHOD FOR PRODUCING COLLECTIBLE CARDS

(71) Applicant: R. R. DONNELLEY & SONS COMPANY, Chicago, IL (US)

(72) Inventors: David Eastwood, Durham, NC (US); Harold Aldridge Benson, Graham, NC (US); Joe Cholewinski, Durham, NC (US)

(73) Assignee: R. R. Donnelley & Sons Company, Chicago, IL (US)

( * ) Notice: Subject to any disclaimer, the term of this patent is extended or adjusted under 35 U.S.C. 154(b) by 241 days.

(21) Appl. No.: 16/709,443

(22) Filed: Dec. 10, 2019

(65) Prior Publication Data

US 2020/0108417 A1 Apr. 9, 2020

Related U.S. Application Data

(63) Continuation of application No. 16/539,627, filed on Aug. 13, 2019, now Pat. No. 10,537,920, which is a (Continued)

(51) Int. Cl.
*B65H 33/14* (2006.01)
*B07C 5/36* (2006.01)

(Continued)

(52) U.S. Cl.
CPC ..... *B07C 5/362* (2013.01); *B65H 33/02* (2013.01); *B65H 33/14* (2013.01); *B65H 39/00* (2013.01);

(Continued)

(58) Field of Classification Search
CPC .. B65H 43/00; B65H 43/06; B65H 2301/423; B65H 2301/4228; B65H 2301/4231;

(Continued)

(56) References Cited

U.S. PATENT DOCUMENTS 2,879,991 A 3/1959 Pitner
3,107,912 A * 10/1963 Fiehl ..... G06K 13/14 271/215

(Continued)

FOREIGN PATENT DOCUMENTS

EP 3061715 8/2016
JP 54-116298 10/1979

(Continued)

OTHER PUBLICATIONS

Office Action, and English translation, dated Dec. 8, 2016, for Japanese Patent Application No. 2016-007126, Applicant R.R. Donnelley & Sons Company (12 pages).

(Continued)

*Primary Examiner* — Terrell H Matthews
(74) *Attorney, Agent, or Firm* — McCracken & Gillen LLC

(57) ABSTRACT

Methods and systems of producing collectible cards are disclosed. An example method includes producing a first stack of cards including a first card type and a second card type from a single substrate sheet, separating the first stack of cards into a first sub-stack and a second sub-stack. The first sub-stack includes the first card type and the second sub-stack includes the second card type. The example method includes comparing a first top card of the first sub-stack to a first reference card and, based on the first top card being substantially similar to the first reference card, automatically transferring the first sub-stack to a first tray designated to receive the first card type.

13 Claims, 6 Drawing Sheets

Related U.S. Application Data continuation of application No. 15/860,370, filed on Jan. 2, 2018, now Pat. No. 10,406,563, which is a continuation of application No. 14/709,299, filed on May 11, 2015, now Pat. No. 9,895,720.

(60) Provisional application No. 62/126,263, filed on Feb. 27, 2015.

(51) Int. Cl.

| | |
|---|---|
| ***B65H 33/02*** | (2006.01) |
| ***B65H 39/00*** | (2006.01) |
| ***B65H 43/04*** | (2006.01) |
| ***B65H 43/06*** | (2006.01) |

(52) U.S. Cl.

CPC ..... *B65H 43/04* (2013.01); *B65H 43/06* (2013.01); *B65H 2301/4228* (2013.01); *B65H 2301/431* (2013.01); *B65H 2511/413* (2013.01); *B65H 2701/18265* (2013.01); *B65H 2701/1914* (2013.01)

(58) Field of Classification Search

CPC ..... B65H 2301/43; B65H 2301/431; B65H 83/00; B65H 83/02; B65H 3/00; B65H 33/00; B07C 5/362

USPC ..... 209/552, 577

See application file for complete search history.

(56) References Cited

U.S. PATENT DOCUMENTS

| | | | | |
|---|---|---|---|---|
| 5,261,667 | A * | 11/1993 | Breeding | B65H 3/322 273/149 R |
| 5,989,122 | A | 11/1999 | Roblejo | |
| 6,676,127 | B2 * | 1/2004 | Johnson | A63F 1/12 273/149 P |
| 7,398,134 | B2 | 7/2008 | Carley et al. | |
| 7,413,191 | B2 * | 8/2008 | Grauzer | A63F 1/14 273/149 P |
| 7,753,373 | B2 * | 7/2010 | Grauzer | A63F 1/12 273/149 R |
| 7,959,153 | B2 | 6/2011 | Franks, Jr. | |
| 8,230,665 | B2 | 7/2012 | Pugh et al. | |
| 8,342,525 | B2 | 1/2013 | Scheper et al. | |
| 9,895,720 | B2 | 2/2018 | Eastwood | |
| 2011/0109042 | A1 | 5/2011 | Rynda | |
| 2020/0108417 | A1 * | 4/2020 | Eastwood | B65H 43/04 |

FOREIGN PATENT DOCUMENTS

| | | | | |
|---|---|---|---|---|
| JP | S60196882 | | 10/1985 | |
| JP | 07-315624 | | 5/1995 | |
| JP | 10-275201 | | 10/1998 | |
| JP | 2004-334636 | | 11/2004 | |
| JP | 2013-252157 | | 12/2013 | |
| JP | 2016172641 | A * | 9/2016 | B07C 5/362 |
| WO | WO 2009-069708 | | 6/2009 | |

OTHER PUBLICATIONS

European Patent Office, "European Search Report," issued in connection with European Patent Application No. 16 154 120.6, dated Jul. 5, 2016, 5 pages.

* cited by examiner

300

METHOD FOR PRODUCING COLLECTIBLE CARDS

CROSS REFERENCE TO RELATED APPLICATIONS

The present application is a continuation of U.S. patent application Ser. No. 16/539,627, entitled "Method of Producing Collectible Cards," filed Aug. 13, 2019, which issued on Jan. 21, 2020, as U.S. Pat. No. 10,537,920, which is a continuation of U.S. patent application Ser. No. 15/860,370, entitled "Method of Producing Collectible Cards," filed Jan. 2, 2018, which issued on Sep. 10, 2019 as U.S. Pat. No. 10,406,563, and is a continuation of U.S. patent application Ser. No. 14/709,299, entitled "Method and Apparatus of Producing Collectible Cards," filed May 11, 2015, which issued on Feb. 20, 2018 as U.S. Pat. No. 9,895,720, which in turn claims benefit of U.S. Provisional patent application Ser. No. 62/126,263, filed Feb. 27, 2015. The entire contents of these applications are incorporated herein by reference.

FIELD OF THE DISCLOSURE

This disclosure relates generally to collectible cards, and, more particularly, to methods and apparatus of producing collectible cards.

BACKGROUND

Some collectible cards include tradable sports cards, entertainment cards, playing cards, etc. In some instances, the collectible cards are produced on sheets that are then cut to separate the cards from one another.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
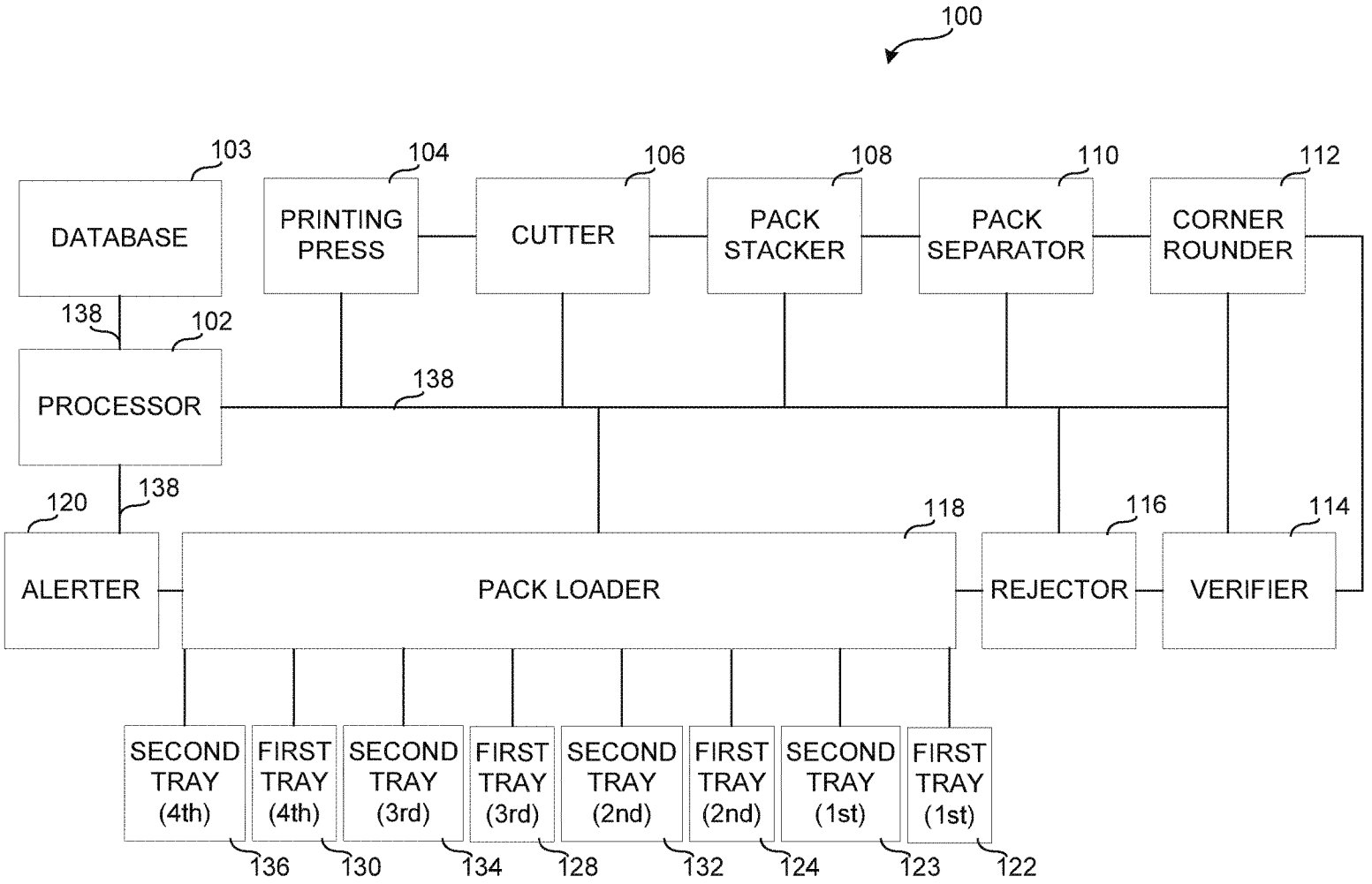
FIG. 1 is a block diagram of an example apparatus that can be used to produce collectible cards in accordance with the teachings of this disclosure.

The examples disclosed herein relate to methods and apparatus of automatically separating, verifying and placing different card types into trays designated for the respective cards. In some examples, sheets of cards are produced having different card types positioned in different zones and/or regions of the sheet. The different card types may include a first card type (e.g., a common card type) that occupies a first number of columns on the sheet (e.g., six columns) and a second card type (e.g., a rare card type) that occupies a second number of the columns on the sheet (e.g., five columns).

In contrast to some examples, the examples disclosed herein reduce the labor intensity of producing such collectible cards, improve quality control and reduce production errors by limiting and/or eliminating the amount of card handling during the production process. For example, using the examples disclosed herein, after the cards are separated and/or cut to their final size from a larger sheet, the cards are stacked and then split into smaller packs of loose cards. The larger sheet may be, for example an 11 card by 11 card sheet (11×11), an 11 card by 10 card sheet (11×10), or have any other dimensions. In some examples, the quality of the smaller packs is verified prior to automatically loading the quality approved cards into designated trays. Once the respective trays are full, in some examples, the trays may be labeled and/or an alert may be generated that alerts an operator to remove the full tray and replace the full tray with an empty tray. In some examples, the tray may be automatically labeled as containing common cards, rare cards, ultra rare cards and/or any other types of cards or combinations of cards.

In some examples, during the quality verification process, an example image recognition apparatus is used to verify the top card of the respective packs, verify a code on the card and/or verify that the quality of the top card(s) or one of the cards within the pack is at or above a threshold value. During the quality verification process, in some examples, if one of the packs is identified as defective and/or not meeting the quality threshold level, the defective pack may be rejected and not loaded into a tray and conveyed away from the process using, for example, a pass-through conveyor. A pack may be identified as being defective for a number for reasons. For example, the pack may be identified as defective if the top card of the pack does not correspond to the appropriate/expected top card for that pack. Not having the appropriate/expected top card may indicate that the order of the cards within the pack is wrong and/or that the pack separator separated the pack of cards in the wrong place. Additionally or alternatively, the quality of the card(s) may be determined to be below a threshold value if the top card is blank and/or the top card includes a printing error, for example. Also, in some examples, the card(s) may be determined to not meet a threshold value of acceptable quality if the top card includes an incorrect code and/or an unrecognizable code. In addition, card(s) may be determined to be defective if there is physical damage present.

FIG. 1 illustrates an example apparatus 100 for producing different types of collectable cards. In this example, the apparatus 100 includes a processor 102, a database 103, a printing press 104, a cutter 106, a pack stacker 108, a pack separator 110, a corner rounder 112, a verifier 114, a rejector 116, a pack loader 118 and an alerter 120. To control the operation of the apparatus 100, the processor 102 may be communicatively coupled to one or more of the database 103, the printing press 104, the cutter 106, the pack stacker 108, the pack separator 110, the corner rounder 112, the verifier 114, the rejector 116, the pack loader 118 and/or the alerter 120.

In operation, the processor 102 obtains a run order from the database 103. The run order may include the type of cards being produced and/or the cards to be produced on a particular sheet. For example, the run order may include instructions to run one thousand sheets of a first sheet type prior to transitioning and running one thousand sheets of a second sheet type. In some examples, the apparatus 100 may changeover from running the first sheet type to running the second sheet type in-line with little if any operator involvement (e.g., the changeover may occur automatically based on instructions received).

Figure 2:
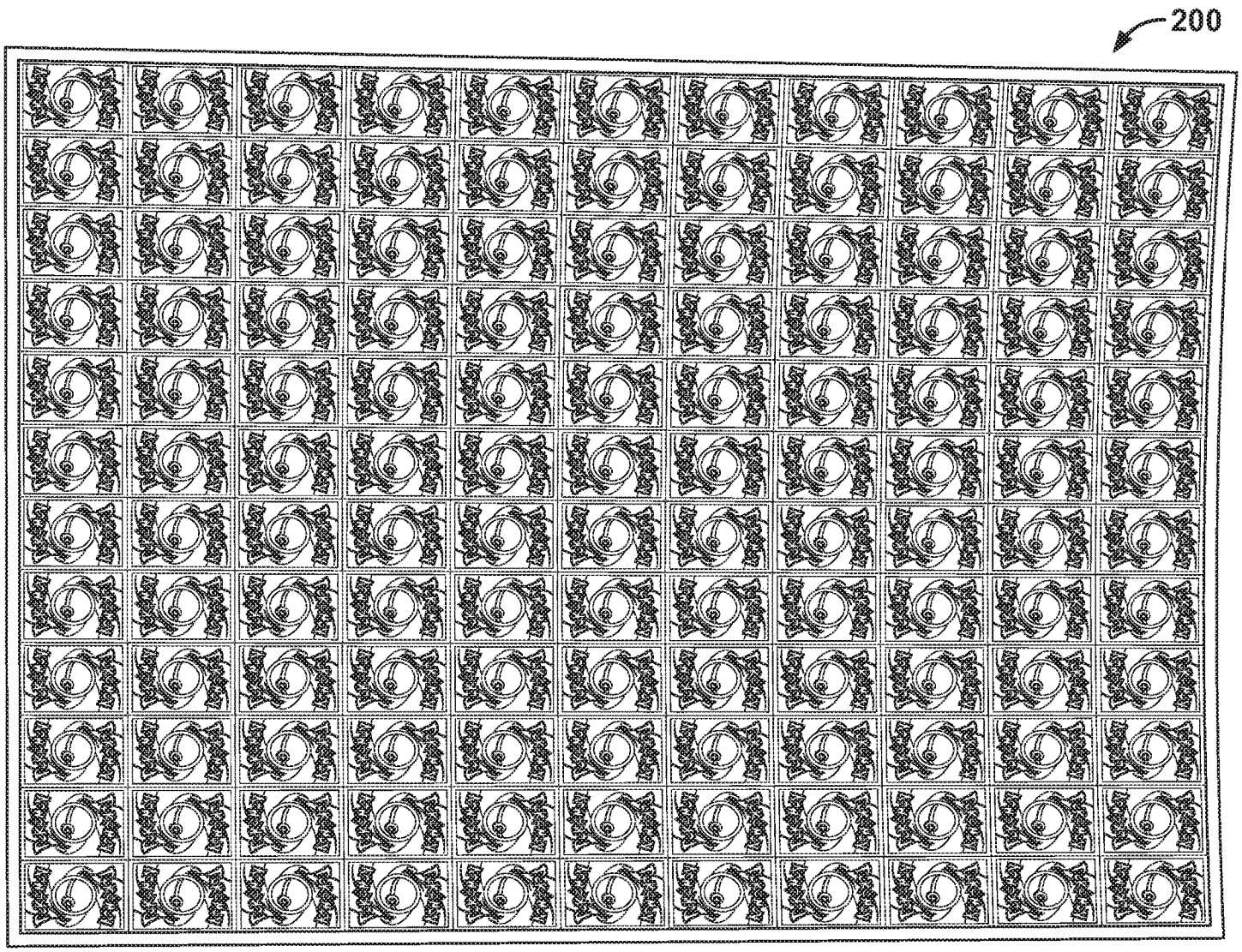
FIG. 2 shows an example sheet of collectible cards produced using the example apparatus of FIG. 1.

In some examples, the first sheet type may include the same cards in the same order and the second sheet type may include the same cards in the same order. For example, as shown in the example of FIG. 2, a first sheet type 200 includes 11 columns of cards and 11 rows of cards. In some examples, the first six columns of cards are classified as common cards and the last five columns of cards are classified as rare cards. While an example is provided of the first sheet including two different card classifications (a two-split sheet), the apparatus 100 may produce other example sheets such as a three-split sheet, a four-split sheet, etc. While an example is provided of an example number of cards included in the sheet, other examples may be provided where the number of cards in the sheet(s) is different.

Based on the run order obtained, the processor 102 may cause the printing press 104 to print a particular number of sheets of the first sheet type prior to transitioning to run the second sheet type, for example. In some examples, the printing press 104 may include one or more operations to image and/or print the front of the sheet and/or the back of the sheet. Depending on the type of cards being produced, the different cards on the first sheet may include the same text, image(s) and/or pattern(s) on the back of the card and different text(s), image(s) and/or pattern(s) on the front of the card, for example. However, in some examples, the back of the cards produced may have different text, image(s) and/or pattern(s) and the front of the cards produced may have similar indicia. Any combination of indicia may be used on any surface of the cards.

In this example, the printed sheets are separated into individual cards using the cutter 106. After the cutter 106 separates the cards, the pack stacker 108 stacks the cards from a particular sheet into a pack. In some examples, to ensure that a known order of cards is maintained, the pack stacker 108 stacks the cards in an order that corresponds to the order that the cards are positioned within the sheet and/or another desired order. However, in other examples, the pack stacker 108 may stack the cards in any order depending on the operational requirements of the apparatus 100 and/or the type of cards being produced, for example. In yet other examples, the cards may be randomly stacked.

To separate the first card type from the second card type within the pack in examples in which the formed packs include two card types, in the example of FIG. 1, the pack separator 110 separates the pack based on instructions received from the processor 102. In some examples, the separated packs undergo additional processing, as disclosed herein, and eventually are transferred by the pack loader 118 to the first and/or second trays 122, 123. In some examples, the pack separator 110 uses information regarding how many cards are contained within the respective trays 122, 123 to determine where to split the pack. For example, if a first tray 122 is empty that is designated to receive the first card type, the pack separator 110 may split the pack of cards to form a first sub-stack of cards that includes the first card type from the pack and a second sub-stack of cards that includes the second card type from the pack. Then, the first stack of the first card type may be transferred by the pack loader 118 to the first tray 122 and the second sub-stack of the second card type may be transferred by the pack loader 118 to the second tray 123 designated to receive the second card type.

In other examples, if the first tray 122 is almost full and cannot accommodate the entire first stack of cards of the first card type, instead of splitting the pack into the first sub-stack and the second sub-stack, as mentioned above, the pack separator 110 may split the pack to form first and second partial stacks (e.g., partial sub-stacks) of the first card type and a second sub-stack of the second card type. Then, the first partial stack of the first card type may be transferred by the pack loader 118 to the first tray 122, the second partial stack of the first card type may be transferred by the pack loader 118 to a next first tray 124 and the second sub-stack of the second card type may be transferred by the pack loader 118 to the second tray 123.

Figure 3:
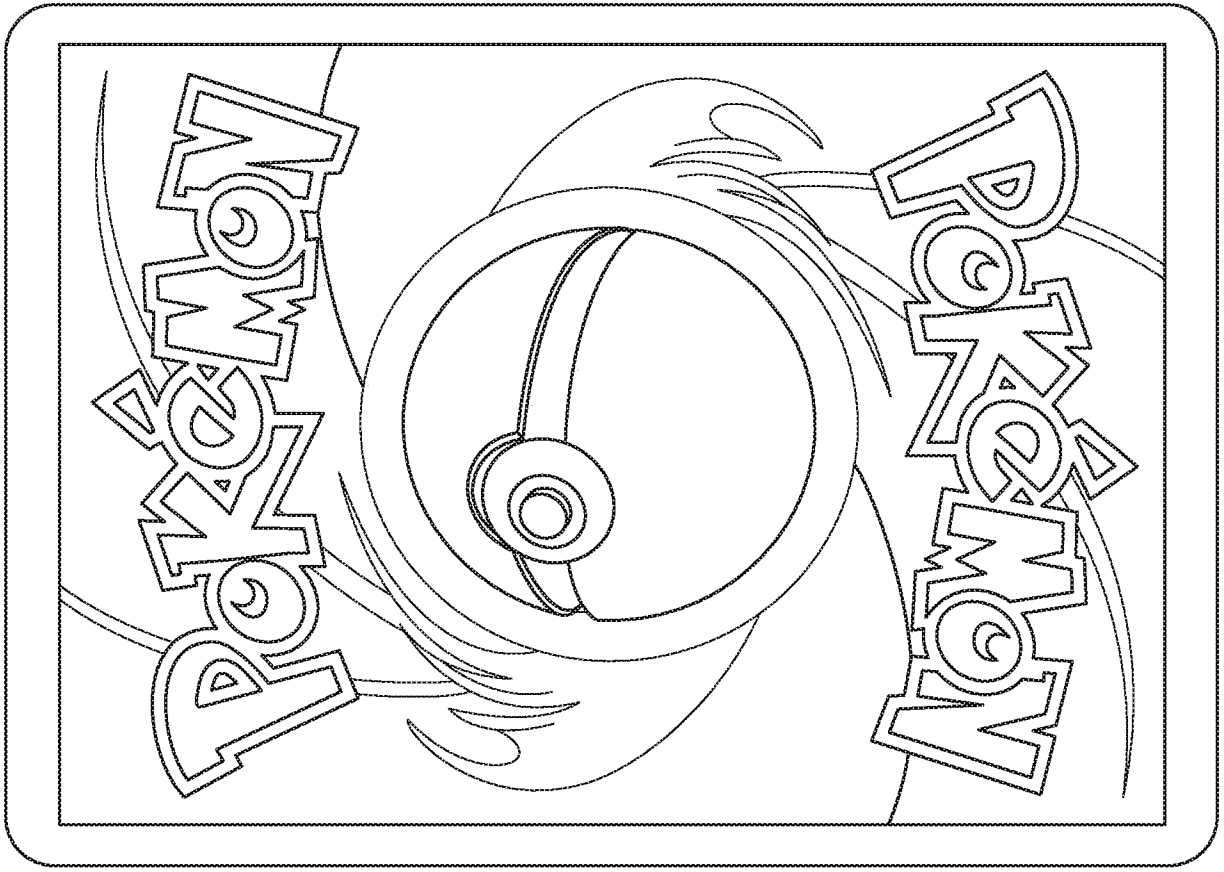
FIG. 3 shows an example collectible card produced using the examples disclosed herein.
Figure 4:
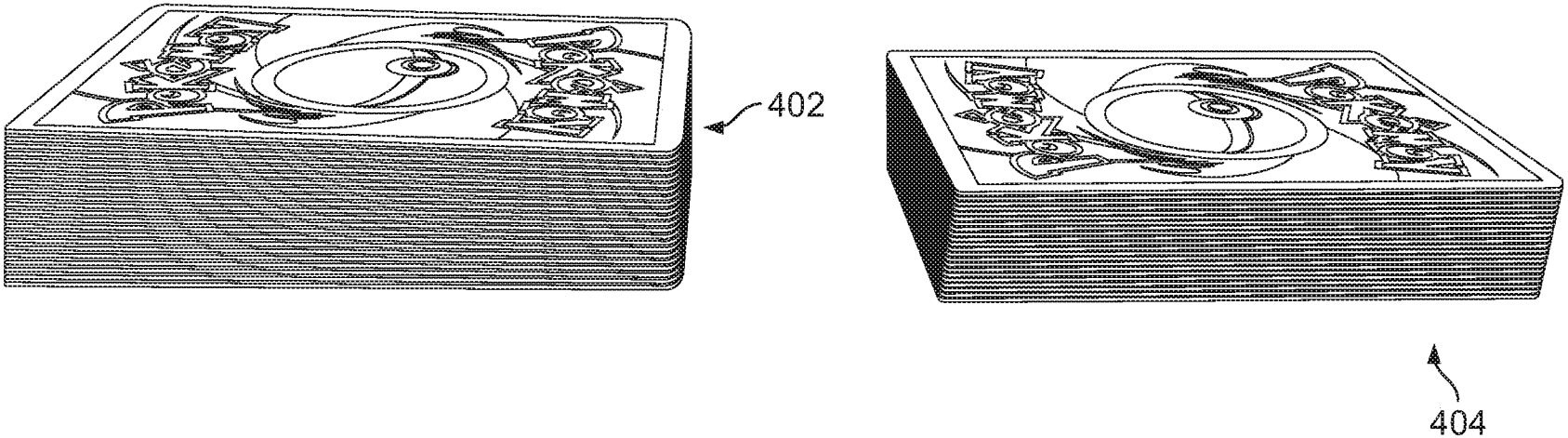
FIG. 4 shows example stacks of collectible cards produced using the examples disclosed herein.

After the pack separator 110 separates the respective packs, in this example, the corner rounder 112 is used to cut and/or round one or more of the corners of one or more of the respective cards. An example of a separated card 300 having rounded corners is shown in FIG. 3. Example first and second sub-stacks 402, 404 of cards having rounded corners is shown in FIG. 4. After the corners are rounded, the verifier 114 reviews the quality of one or more cards included in the packs output by the corner rounder 112 and/or verifies that one or more of the cards included in the packs are the proper cards and/or in an expected order. For example, the verifier 114 may include a camera that takes a photo of the top card of the first sub-stack and the processor 102 compares the imaged top card to an image of a reference card stored in the database 103 to determine if the top card matches the reference card. In some examples, based on the sheet being produced, the cards output by the pack separator 110 are ordered in an expected order. Therefore, by comparing the image of the top card of the first sub-stack to the image of the expected top card, the examples disclosed herein substantially ensure that the quality and/or the predetermined order of the cards produced is maintained, for example.

If the verifier 114 and/or the processor 102 determines that the reviewed sub-stack does not meet the quality threshold and/or does not contain the proper cards, the rejected sub-pack is rejected by the rejector 116 and, thus, does not move to the pack loader 118. However, if the verifier 114 and/or the processor 102 determines that the reviewed sub-stack meets the quality threshold and/or contains the proper cards, the quality approved sub-pack moves to the pack loader 118.

In some examples, the pack loader 118 loads the first card type into the first tray 122 and the second card type into the second tray 123. In this example, when the pack loader 118 receives an indication from the processor 102 that the first tray 122 is full, the pack loader 118 begins to load the next first tray 124 designated to receive the first card type. In this example, the trays 122, 124, 128, 136 are designated to receive the first card type and the trays 123, 132, 134, 136 are designated to receive the second card type. However, the apparatus 100 may include a different number of trays that are configured and/or arranged to receive any card type (e.g., a first card type, a second card type, a third card type, a fourth card type, etc.).

In this example, once the first tray 122 is full, the processor 102 causes the alerter 120 to generate an alert to notify an operator to exchange the full first tray 122 and replace the full tray with an empty tray. Additionally or alternatively, the alerter 120 may provide an alert if the loaded tray is improperly loaded, etc., based on feedback received by a sensor (e.g., proximity sensor) adjacent the tray, for example. When the first and second sub-packs include a different number of cards such as, for example, 66 cards or 55 cards (or any other suitable or desired number of cards), the first tray 122 may become full at a different rate than the second tray 123.

In some examples, if the remaining space in the first tray 122 is less than the entire first sub-stack of the first card type (e.g., the first tray is not capable of housing an additional 66 cards), the processor 102 causes the pack separator 110 to split the sub-pack to form first and second partial stacks of the first card type where the first partial stack includes a number of cards to completely fill the remaining space in the first tray, for example. Once the first partial stack is approved by the verifier 114, the pack loader 118 transfers the first partial pack into the first tray 122 and the second partial pack into the next first tray 124. By splitting the first stack into partial packs that are distributed to the different trays 122, 124, the apparatus 100 further increases the distribution of the different card types and/or decreases the likelihood that a customer opening a pack of cards produced can predict the type of cards within that pack (e.g., prevents the customer from accurately predicting that a particular pack of cards includes a particular rare card).

In this example, to reduce an amount of downtime incurred when replacing a full tray with an empty tray, the example apparatus 100 includes four trays 122, 124, 128, 130 designated to receive the first card type and four trays 123, 132, 134, 136 designated to receive the second card type. However, the apparatus 100 may include any number of trays (e.g., four, six, nine, ten, etc.) to receive the number of different card types being produced (e.g., one, three, four, five, etc.).

The example processor 102, the example database 103, the example printing press 104, the example cutter 106, the example pack stacker 108, the example pack separator 110, the example corner rounder 112, the example verifier 114, the example rejector 116, the example pack loader 118 and the alerter 120 are communicatively coupled via communication links 138. The communication links 138 may be any type of wired connection (e.g., a databus, a USB connection, etc.) or a wireless communication mechanism (e.g., radio frequency, infrared, etc.) using any past, present or future communication protocol (e.g., Bluetooth, USB 2.0, USB 3.0, etc.). Also, the components of the example system 100 may be integrated in one device or distributed over two or more devices.

While an example manner of implementing the apparatus 100 is illustrated in FIG. 1, one or more of the elements, processes and/or devices illustrated in FIG. 1 may be combined, divided, re-arranged, omitted, eliminated and/or implemented in any other way. Further, the example processor 102, the example database 103, the example printing press 104, the example cutter 106, the example pack stacker 108, the example pack separator 110, the example corner rounder 112, the example verifier 114, the example rejector 116, the example pack loader 118 and the alerter 120 and/or, more generally, the example apparatus 100 of FIG. 1 may be implemented by any combination of hardware, software and/or firmware. Thus, for example, any of the example processor 102, the example database 103, the example printing press 104, the example cutter 106, the example pack stacker 108, the example pack separator 110, the example corner rounder 112, the example verifier 114, the example rejector 116, the example pack loader 118 and the alerter 120 and/or, more generally, the example apparatus 100 of FIG. 1 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, the example processor 102, the example database 103, the example verifier 114, the example rejector 116, and/or the alerter 120 is/are hereby expressly defined to include a tangible computer readable storage device or storage disk such as a memory, a digital versatile disk (DVD), a compact disk (CD), a Blu-ray disk, etc. storing the software and/or firmware. Further still, the example apparatus 100 of FIG. 1 may include one or more elements, processes and/or devices in addition to, or instead of, those illustrated in FIG. 1, and/or may include more than one of any or all of the illustrated elements, processes and devices.

Figure 5:
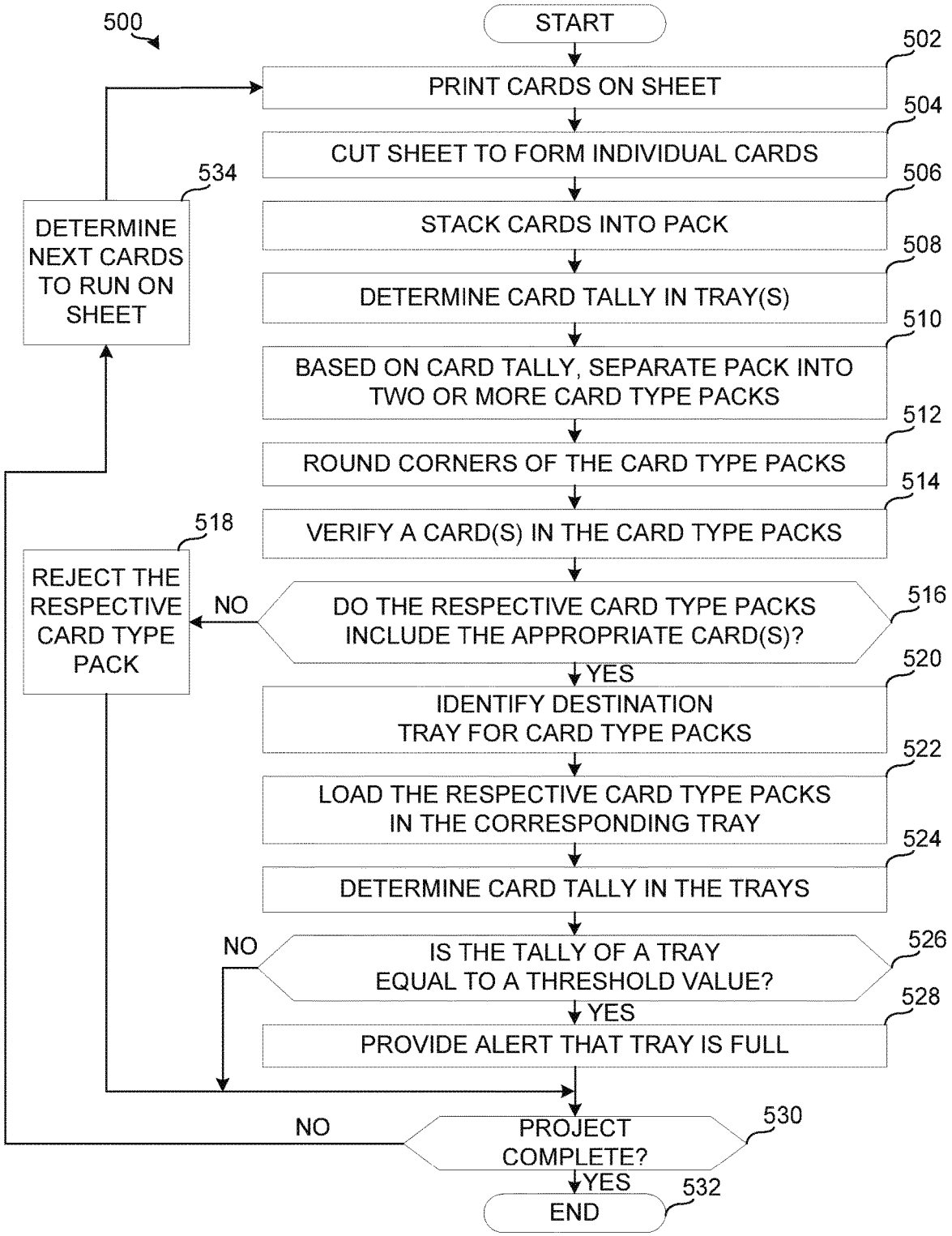
FIG. 5 is a flowchart representative of machine readable instructions that may be executed to implement the example apparatus of FIG. 1.

A flowchart representative of example machine readable instructions for implementing the apparatus 100 of FIG. 1 is shown in FIG. 5. In this example, the machine readable instructions comprise a program for execution by a processor such as the processor 612 shown in the example processor platform 600 discussed below in connection with FIG. 6. The program may be embodied in software stored on a tangible computer readable storage medium such as a CD-ROM, a floppy disk, a hard drive, a digital versatile disk (DVD), a Blu-ray disk, or a memory associated with the processor 612, but the entire program and/or parts thereof could alternatively be executed by a device other than the processor 612 and/or embodied in firmware or dedicated hardware. Further, although the example program is described with reference to the flowchart illustrated in FIG. 5, many other methods of implementing the example apparatus 100 may alternatively be used. For example, the order of execution of the blocks may be changed, and/or some of the blocks described may be changed, eliminated, or combined.

As mentioned above, the example processes of FIG. 5 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Additionally or alternatively, the example processes of FIG. 5 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

The example process 500 of FIG. 5 includes printing one or more card(s) on one or more sheet(s) (block 502) by, for example, the processor 102 causing the printing press 104 to print a particular number of sheets of the first sheet type based on a run order received from the database 103 of FIG. 1. After the cards of the first sheet type are printed, in this example, the printed sheets are separated into individual cards (block 504) using, for example, the cutter 106. The example process 500 also includes stacking the cards into one or more pack(s) (block 506). For example, the pack stacker 108 may be used to stack the cards from a particular sheet into a pack. At block 508, the example process 500 determines the number of cards positioned in different trays (e.g., the trays 122, 123, 124, 132, 128, 134, 130, 136 of FIG. 1) using, for example, the processor 102. For example, if no cards have been placed in the one or more of the trays 122, 123, 124, 132, 128, 134, 130, 136, the processor 102 determines that the respective tray(s) are empty. Based on the number of cards positioned within the trays 122, 123, 124, 132, 128, 134, 130, 136, the process 500 separates the pack (block 510) using, for example, the pack separator 110. For example, if the processor 102 determines that the first tray 122 can only accommodate a partial stack of the first card type, the pack separator 110 may split the pack to form first and second partial sub-stacks of the first card type and a second sub-stack of the second card type.

After the pack separator 110 separates the respective packs, in this example, the process 500 rounds and/or cuts the corners of the cards (block 512) using, for example, the corner rounder 112. After the corners are rounded, the process 500 reviews the quality of one or more cards included in the packs output by the corner rounder 112 and/or verifies that one or more of the cards included in the packs are the proper and/or expected cards (block 514) using, for example, the verifier 114.

At block 516, the process 500 determines if the stack includes the appropriate card(s) and/or meets a quality threshold (block 516) using, for example, the verifier 114 and/or the processor 102. If the verifier 114 and/or the processor 102 determines that the reviewed stack does not meet the quality threshold and/or does not contain the proper cards, the process 500 rejects the pack (block 518) using, for example, the rejector 116. After the pack is rejected (block), the example process 500 determines if the project or run is complete (block 530). However, if the process 500 determines (block 516) that the reviewed stack meets the quality threshold and/or contains the proper cards, the quality approved pack moves to the pack loader 118, and the example process 500 advances to block 520.

At block 520, the process 500 determines the tray (e.g., which of the trays 122, 123, 124, 132, 128, 134, 130, 136 of FIG. 1) to load the stack output by the verifier 114 using, for example, the processor 102 and/or the pack loader 118. For example, if the first tray 122 is not full, the processor 102 and/or the pack loader 118 may determine to continue to transfer packs including the first card type to the first tray 122. However, once the first tray 122 is determined to be full, the processor 102 and/or the pack loader 118 may determine to transfer packs including the first card type to the next first tray 124, for example.

With the destination tray identified, the process 500 causes the packs of the respective card types to be loaded into the appropriate tray designated to receive the respective card types/stack/sub-stacks (block 522) using, for example, the pack loader 118. At block 524, the process 500 determines the number (tally) of cards positioned in the trays (block 524) using, for example, the processor 102. The process 500 then determines if the tally within the trays is equal to a threshold value indicative that one or more of the tray(s) (e.g., the trays 122, 123, 124, 132, 128, 134, 130, 136 of FIG. 1) is full (block 526) using, for example, the processor 102. If the tally within the trays meets a threshold value indicative that one or more of the tray(s) is full, the process 500 generates an alert (block 528) that notifies an operator to changeout the full tray(s) using, for example, the alerter 120. The example process 500 also determines if the project is complete (block 530), and, if so, the example process ends (block 532).

If the example process 500 determines that the project is not complete (block 530), the example process 500 continues and determines the next cards to run on the sheet to be produced (block 534) using, for example, processor 102. For example, based on the run order within the database 103, the processor 102 may determine to continue to produce the first sheet type or the processor 102 may determine to changeover to produce a second sheet type (e.g., the same card type, a different card type, etc.). In some examples, the run order may be dynamically updated based on the cards being rejected by the process 500 and/or for any other reason. In some examples, the first sheet type includes a first type of cards (e.g., baseball cards, entertainment playing cards) and the second sheet type includes a second type of cards (basketball cards, different entertainment playing cards). When the example process 500 determines the next cards to run (block 534), the example process 500 continues through from block 502.

Figure 6:
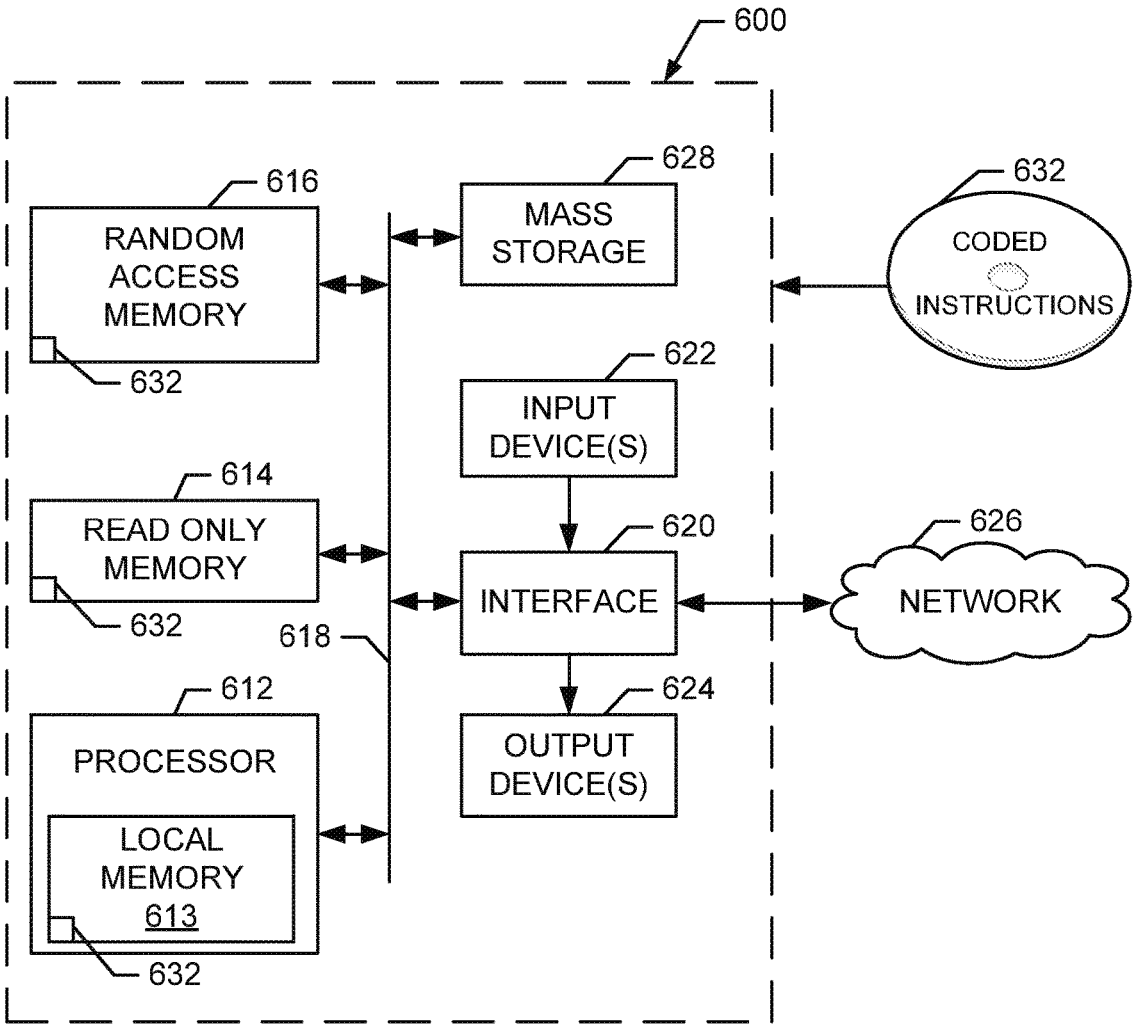
FIG. 6 is a processor platform to execute the instructions of FIG. 5 to implement the apparatus of FIG. 1.

FIG. 6 is a block diagram of an example processor platform 1000 capable of executing the instructions of FIG. 5 to implement the apparatus 100 of FIG. 1. The processor platform 600 can be, for example, a server, a personal computer, a mobile device (e.g., a cell phone, a smart phone, a tablet such as an iPad.RTM.), a personal digital assistant (PDA), an Internet appliance, a DVD player, a CD player, or any other type of computing device.

The processor platform 600 of the illustrated example includes a processor 612. The processor 612 of the illustrated example is hardware. For example, the processor 612 can be implemented by one or more integrated circuits, logic circuits, microprocessors or controllers from any desired family or manufacturer.

The processor 612 of the illustrated example includes a local memory 613 (e.g., a cache). The processor 612 of the illustrated example is in communication with a main memory including a volatile memory 614 and a non-volatile memory 616 via a bus 618. The volatile memory 614 may be implemented by Synchronous Dynamic Random Access Memory (SDRAM), Dynamic Random Access Memory (DRAM), RAIVIBUS Dynamic Random Access Memory (RDRAM) and/or any other type of random access memory device. The non-volatile memory 616 may be implemented by flash memory and/or any other desired type of memory device. Access to the main memory 614, 616 is controlled by a memory controller.

The processor platform 600 of the illustrated example also includes an interface circuit 620. The interface circuit 620 may be implemented by any type of interface standard, such as an Ethernet interface, a universal serial bus (USB), and/or a PCI express interface.

In the illustrated example, one or more input devices 622 are connected to the interface circuit 620. The input device(s) 622 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 624 are also connected to the interface circuit 620 of the illustrated example. The output devices 624 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 620 of the illustrated example, thus, typically includes a graphics driver card, a graphics driver chip or a graphics driver processor.

The interface circuit 620 of the illustrated example also includes a communication device such as a transmitter, a receiver, a transceiver, a modem and/or network interface card to facilitate exchange of data with external machines (e.g., computing devices of any kind) via a network 626 (e.g., an Ethernet connection, a digital subscriber line (DSL), a telephone line, coaxial cable, a cellular telephone system, etc.).

The processor platform 600 of the illustrated example also includes one or more mass storage devices 628 for storing software and/or data. Examples of such mass storage devices 628 include floppy disk drives, hard drive disks, compact disk drives, Blu-ray disk drives, RAID systems, and digital versatile disk (DVD) drives.

The coded instructions 632 of FIG. 5 may be stored in the mass storage device 628, in the volatile memory 314, in the non-volatile memory 616, and/or on a removable tangible computer readable storage medium such as a CD or DVD.

From the foregoing, it will be appreciated that the above disclosed methods, apparatus and articles of manufacture relate to separating, verifying and/or placing loose stacks of cards, such as collectible cards, into designated trays. In some examples, a single sheet of cards may include different types of cards that are to be separated and placed in different trays designated to receive the different cards. The different types of cards may vary depending on the type of collectible cards being produced (e.g., playing cards, entertainment cards (e.g., Pokemon, Magic the Gathering, etc.), sports cards, etc.). In some examples, the different types of cards may be classified based on their rarity (e.g., common cards, rare cards, ultra rare cards, etc.) and/or some other characteristic.

To produce some collectible cards in accordance with the teachings of this disclosure, in some examples, the cards are printed onto sheets of 11 cards by 11 cards. To separate the cards from one another, in some examples, a Rollem Slipstream unit is used. In some examples, after the cards are separated from one another such that individual loose cards are formed, the loose cards are stacked into a pack. The individual loose cards may be stacked in an order that corresponds to the order in which each card is disposed on the sheet. For example, the first card of the first column of the sheet may be the first card of the pack and the last card of the last column of the sheet may be the last card of the pack.

In some examples, the pack of cards is separated based on the type of cards included in the pack. For example, in examples in which the first six columns of the sheet is designated as a first card type and the last five columns of the sheet is designated as a second card type (e.g., a two-split or A-B split), a card separator may separate the pack such that a first sub-stack is formed that includes the first card type and a second sub-stack is formed that includes the second card type. After the cards are separated based on, for example, card type, the corners of the cards may be rounded using a Ruge & Singer (R&S) round cornerer.

In some examples, the first and second cards types are then output and reviewed for quality. The respective card packs may be reviewed for quality using an image recognition process, a camera that verifies the top card of each stack and/or a sensor that verifies a code on the card. The code may be any suitable code such as a barcode, a 2-dimensional code including an embedded uniform resource locators (URL), etc. To enable quality review, the cards may be positioned such that a defining characteristic of the card faces up and/or toward the camera and/or the sensor. For example, if the back of the card is a pattern common to all cards of a first card type and the front of card is an ace of spades, the ace of spades will face the camera and/or sensor for quality review purposes.

In some examples, the top card may be verified by comparing and/or matching characteristics of the top card to a reference card. An image of the reference card(s) may be stored in a database and a processor may be used to compare the image taken of the top card to the reference card, for example. If the top card is not the expected card (e.g., the top card does not match the reference card) and/or if the quality of the top card falls below a threshold value, the pack may be rejected using, for example, a pass-through conveyor. In some examples, rejecting packs that do not include the appropriate top card substantially ensures that the expected order of the cards being produced is maintained. In some examples, packs are rejected if all of the trays are identified as being full.

After the quality of the respective packs are reviewed, in some examples, packs meeting the quality threshold value are transferred to appropriate trays. In examples in which the separated sheet includes a first card type and a second card type, a first tray may be designated to receive the first card type and a second tray may be designated to receive the second card type. In some examples, a conveyor using driven rollers and a pass-through air ram pusher may be used to transfer the packs to the respective trays. In some examples, the cards may be inserted into the tray with the short edge leading and/or the trays may be placed at an angle to facilitate loading.

In examples in which the first pack includes a different number of cards than the second pack, the first tray may become full at a different rate than the second tray. In some such examples, a processor monitors a tally of the number of cards and/or the number of columns of cards within the respective trays and, once one of the trays is full, the processor causes the card mover to begin filling the next tray designated for the respective card. For example, if the remaining space within a tray is two columns worth of the first card type (e.g., 22 cards) and the first card type typically includes six columns worth of cards (e.g., 66 cards), the processor may cause the card separator to separate the first pack of the first card type further such that two columns worth of the first card type is separated out and then transferred into the partially full tray to fill the tray and the remaining four columns worth of the first card type is separated out and then transferred into the next empty tray designated to receive the first card type. Beginning a tray with the last four columns of the first card type as opposed to using all six columns of the first card type may further decrease the likelihood that a predicable order can be established for the card packs produced using the cards within the trays (e.g., one cannot predict that the first pack of cards in a box includes a particular rare card).

In some examples, once the trays are full, the full trays are ejected and/or an alert is provided for an operator to transfer out the full tray and replace the full tray with an empty tray. The operator may provide an input indicating when the full tray has been replaced with an empty tray and/or a sensor may identify when an empty tray has been received. In some examples, a sensor may be used to sense if the empty tray is improperly positioned and/or jammed, for example.

The full trays may be moved to a card feeder line where the full trays are used to produce and/or build packs of cards using a randomization algorithm that balances the number of first and/or second cards within each pack in an unpredictable sequence. In some examples, to reduce an amount of downtime incurred when replacing a full tray with an empty tray, multiple trays configured to receive a first card type (e.g., four trays) and multiple trays configured to receive a second card type (e.g., four trays) may be used in connection with the examples disclosed herein. Thus, once one tray of the first card type is full, the processor causes the card mover to begin placing cards within the next tray of the first card type, for example.

An example method includes producing a first stack of cards including a first card type and a second card type from a single substrate sheet and separating the first stack of cards into a first sub-stack and a second sub-stack. The first sub-stack includes the first card type and the second sub-stack includes the second card type. The example method includes comparing a first top card of the first sub-stack to a first reference card and, based on the first top card being substantially similar to the first reference card, automatically transferring the first sub-stack to a first tray designated to receive the first card type.

In some examples, the example method includes determining a first number of cards within the first tray. In some examples, the example method includes producing a second stack of cards including the first card type and the second card type. In some examples, the example method includes separating the second stack of cards into a third sub-stack and a fourth sub-stack, the third sub-stack including the first card type and the fourth sub-stack including the second card type, comparing a second top card of the third sub-stack to a second reference card and, based on the second top card not being substantially similar to the reference card, rejecting the third sub-stack and not transferring the third sub-stack to the first tray.

In some examples, the example method includes separating the second stack of cards into a third sub-stack includes the first card type and a fourth sub-stack includes the first card type if the first number exceeds a threshold value. In some examples, the number of cards within the second stack of cards is greater than the threshold value. In some examples, the example method includes comparing a second top card of the third sub-stack to a second reference card and, based on the second top card being substantially similar to the second reference card, automatically transferring the third sub-stack to the first tray.

In some examples, the third sub-stack includes a second number of cards equal to the threshold value. In some examples, the example method includes generating an alert indicative of the first tray being full. In some examples, the example method includes comparing a second top card of the fourth sub-stack to a second reference card and, based on the second top card being substantially similar to the second reference card, automatically transferring the fourth sub-stack to a second tray designated to receive the first card type. In some examples, comparing the first top card of the first sub-stack to the first reference card includes comparing quality characteristics of the first top card to quality characteristics of the first reference card. In some examples, the cards include collectible cards. In some examples, the first card type is different than the second card type. In some examples, the example method includes producing a second stack of cards including a third card type and a fourth card type, separating the second stack of cards into a third sub-stack and a fourth sub-stack, the third sub-stack includes the third card type and the fourth sub-stack includes the fourth card type, comparing a second top card of the third sub-stack to a second reference card and, based on the second top card being substantially similar to the second reference card, automatically transferring the third sub-stack to a second tray designated to receive the third card type. In some examples, the first card type is different than the third card type.

An example apparatus includes a card separator to separate a stack of cards into a first sub-stack and a second sub-stack. The first sub-stack includes a first card type and the second sub-stack includes a second card type. The example apparatus includes a verifier to determine a first quality value of a first top card of the first sub-stack and a stack loader to, in response to receiving an indication from a processor that the quality value is at a first threshold quality level, automatically transfer the first sub-stack to a first tray designated to receive the first card type. In some examples, the apparatus includes a printing press to produce a sheet of cards including the first card type and the second card type. In some examples, the apparatus includes a cutter and a stacker, the cutter to separate the sheet of cards and the stacker to stack the cards into the stack separated by the card separator. In some examples, the apparatus includes a rejector to, in response to receiving an indication from the processor that the quality value of a second top card of the second sub-stack is below the threshold quality level, automatically reject the second sub-stack. In some examples, the verifier is to determine a second quality value of a second top card of the second stack.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

We claim:

1. A method comprising the steps of:

determining a first number of cards of a first card type in a first tray, a second number of cards of a second card type in a second tray, and a third number of cards of the first card type in a third tray;

when the first number satisfies a first threshold, separating a stack of cards into a first partial sub-stack, a second partial sub-stack, and a third sub-stack, the first partial sub-stack including the first card type, the second partial sub-stack including the first card type, and the third sub-stack including the second card type, the first partial sub-stack being sized not to overfill the first tray when the first partial sub-stack is positioned in the first tray; and determining a first quality value of a first top card of the first partial sub-stack and determining a second quality value of a second top card of the second partial sub-stack when the first number satisfies the first threshold; and in response to receiving an indication from a processor that the first quality value satisfies a second threshold, automatically transferring the first partial sub-stack to the first tray; and in response to receiving an indication from the processor that the second quality value satisfies a third threshold, automatically transferring the second partial sub-stack to the third tray.

2. The method of claim 1, further including the step of producing a second stack of cards including the first card type and the second card type.

3. The method of claim 2, further including the steps of separating the second stack of cards into a sixth sub-stack and a seventh sub-stack, the sixth sub-stack including the first card type and the seventh sub-stack including the second card type, comparing a third top card of the sixth sub-stack to a reference card, and, based on the third top card not being substantially similar to the reference card, rejecting the sixth sub-stack and not transferring the sixth sub-stack to the first tray.

4. The method of claim 3, further including the step of separating the second stack of cards into an eighth sub-stack including the first card type and a ninth sub-stack including the first card type if the first number exceeds a threshold value.

5. The method of claim 3, further including the step of automatically transferring the sixth sub-stack to the first tray if the third top card is substantially similar to the reference card.

6. The method of claim 5, wherein the sixth sub-stack includes a fourth number of cards equal to the threshold value.

7. The method of claim 6, further including the step of generating an alert indicative of the first tray being full.

8. The method of claim 3, wherein the step of comparing the third top card of the sixth sub-stack to the reference card includes the step of comparing quality characteristics of the third top card to quality characteristics of the reference card.

9. The method of claim 1, wherein the cards comprise collectible cards.

10. The method of claim 1, wherein the first card type is different than the second card type.

11. The method of claim 1, further including the steps of producing a second stack of cards including a third card type and a fourth card type, separating the second stack of cards into a fourth sub-stack and a fifth sub-stack, the fourth sub-stack including the third card type and the fifth sub-stack including the fourth card type, comparing a third top card of the fourth sub-stack to a reference card, and based on the third top card being substantially similar to the reference card, automatically transferring the fourth sub-stack to a fourth tray designated to receive the third card type.

12. The method of claim 11, wherein the first card type is different than the third card type.

13. The method of claim 1, further including the steps of, when the first number does not satisfy the first threshold, separating the stack of the cards into a fourth sub-stack and a fifth sub-stack, the fourth sub-stack including the first card type, the fifth sub-stack including the second card type and loading the fourth sub-stack in the first tray.

* * * * *